United States Patent [19]

Ladd, Jr. et al.

[11] Patent Number: 4,998,617

[45] Date of Patent: Mar. 12, 1991

[54] FACIAL COSMETIC LIQUID MAKE UP KIT

[75] Inventors: James E. Ladd, Jr., Rowayton; Francis Busch, Jr., Southbury, both of Conn.

[73] Assignee: Laura Lupton Inc, Norwalk, Conn.

[21] Appl. No.: 907,453

[22] Filed: Sep. 15, 1986

[51] Int. Cl.[5] ..... B65D 25/08

[52] U.S. Cl. ..... 206/219; 206/223

[58] Field of Search ..... 132/79 A, 7, 9; 206/459, 229, 221, 219, 363, 223, 232; 215/303; 229/95

[56] References Cited

U.S. PATENT DOCUMENTS

| | | | |
|---|---|---|---|
| 2,017,800 | 10/1935 | Hilgenberg | 206/363 |
| 2,250,666 | 7/1941 | Godefroy | 206/219 |
| 2,629,508 | 2/1953 | Prager | 206/221 |
| 2,819,738 | 1/1958 | Marberg | 206/219 |
| 3,088,586 | 5/1963 | Hardman | 206/211 |
| 3,590,989 | 7/1971 | Wittwer | 206/459 |
| 4,130,198 | 12/1978 | Aho | 206/221 |

*Primary Examiner*—Kenneth J. Dorner
*Assistant Examiner*—J. Hakomaki

[57] ABSTRACT

A kit for preparing different colors and shades of facial cosmetic liquid make up which employs at least one relatively large container almost filled with a first cosmetic liquid. The first liquid when applied to the skin of a user imparts a different selected one of a plurality of basic colors to the skin. The first liquid is an oil in water emulsion with water as the external phase. The kit also employs at least one small sealed plastic pouch containing a small quantity of a second cosmetic liquid which when combined and mixed with the first liquid in the container will almost fill the container. The mixture of liquids when applied to the skin imparts a different selected one of shades associated with the selected color to the skin. The second liquid is an oil in water emulsion with water as the external phase.

2 Claims, 2 Drawing Sheets

| | GOLD (300) | LT. GOLD (302) | PEACH | LT. PEACH | ROSE | LT. ROSE | BLUSH | LT. BLUSH |
|---|---|---|---|---|---|---|---|---|
| WHITE (400) | WHITE GOLD | WHITE LT. GOLD | WHITE PEACH | WHITE LT. PEACH | WHITE ROSE | WHITE LT. ROSE | WHITE BLUSH | WHITE LT. BLUSH |
| BLUE (402) | BLUE GOLD | BLUE LT. GOLD | BLUE PEACH | BLUE LT. PEACH | BLUE ROSE | BLUE LT. ROSE | BLUE BLUSH | BLUE LT. BLUSH |
| RED | RED GOLD | RED LT. GOLD | RED PEACH | RED LT. PEACH | RED ROSE | RED LT. ROSE | RED BLUSH | RED LT. BLUSH |
| YELLOW | YELLOW GOLD | YELLOW LT. GOLD | YELLOW PEACH | YELLOW LT. PEACH | YELLOW ROSE | YELLOW LT. ROSE | YELLOW BLUSH | YELLOW LT. BLUSH |
| BROWN | BROWN GOLD | BROWN LT. GOLD | BROWN PEACH | BROWN LT. PEACH | BROWN ROSE | BROWN LT. ROSE | BROWN BLUSH | BROWN LT. BLUSH |
| CHOCOLATE | CHOCOLATE GOLD | CHOCOLATE LT. GOLD | CHOCOLATE PEACH | CHOCOLATE LT. PEACH | CHOCOLATE ROSE | CHOCOLATE LT. ROSE | CHOCOLATE BLUSH | CHOCOLATE LT. BLUSH |
| RUSSET | RUSSET GOLD | RUSSET LT. GOLD | RUSSET PEACH | RUSSET LT. PEACH | RUSSET ROSE | RUSSET LT. ROSE | RUSSET BLUSH | RUSSET LT. BLUSH |
| BLACK | BLACK GOLD | BLACK LT. GOLD | BLACK PEACH | BLACK LT. PEACH | BLACK ROSE | BLACK LT. ROSE | BLACK BLUSH | BLACK LT. BLUSH |

FIG 4

FACIAL COSMETIC LIQUID MAKE UP KIT

BACKGROUND OF THE INVENTION

The function of facial cosmetic liquid make up when applied to the skin of a user is to impart a uniform color to the skin which, while covering blemishes and other imperfections, looks completely natural. Since skin colors vary over a wide range, different colors of liquid make up have been developed for retail sale in an attempt to satisfy the different color requirements of the bulk of the potential customers. However, there are many more shades of different skin coloring then can be matched acceptably to many users using the conventionally available color selection of perhaps six to eight different colors. As a result, many users must content themselves with make up which does not look completely natural.

The present invention is directed toward a kit for preparing different colors and shades of facial cosmetic liquid make up which will permit a potential user to select any one of a large number of shades which are associated with each one of a plurality of different basic colors and then to have the selected shade prepared immediately at the retail establishment or at home. The Kit is inexpensive and easy to use and does not require the establishment to carry a large and expensive inventory of colors and shades.

SUMMARY OF THE INVENTION

In accordance with the principles of this invention, a relatively large container is almost filled with a first facial cosmetic liquid which is adapted when applied to the skin of a user to impart a different selected one of a plurality of basic colors to the skin. The first is an oil in water emulsion with water as the external phase.

A small sealed plastic pouch contains a small quantity of a second facial cosmetic liquid which when combined and mixed with the first liquid in the container will almost fill the container. The resultant mixture of liquids is adapted when applied to the skin of a user to impart a different one of a plurality of shades associated with the basic color to the skin. The second liquid can be an oil in water emulsion with water as the external phase or can be a mere dispersion of color in water without oil. The second liquid can but need not be identical with any one of the plurality of the basic colors other than contained in the relatively large container.

A Kit in accordance with the invention will comprise a plurality of large containers and a plurality of different pouches. A pouch containing a selected second liquid can be used with one container containing a selected one of the first liquids to produce a desired shade of one basic color and also can be used with another container containing another selected one of the first liquids to produce another desired shade of another basic color.

BRIEF DESCRIPTION OF THE DRAWINGS

FIG. 4 is a plan view of a chart which is used to select different shades of different basic colors of facial cosmetic liquid in accordance with the invention.

DETAILED DESCRIPTION OF PREFERRED EMBODIMENTS

Figure 1:
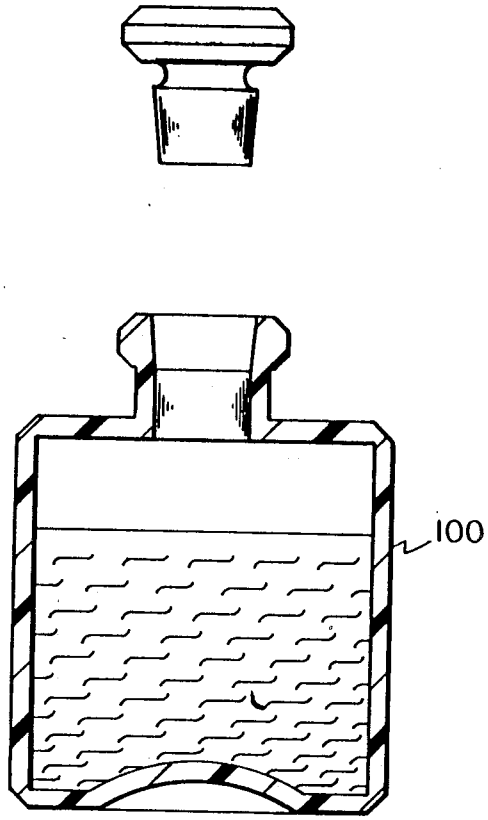
FIG. 1 is a partially cut away view of a relatively large container partially filled with a facial cosmetic liquid having one selected basic color.

Referring first to FIG. 1, there is shown a standard size facial cosmetic liquid container 100 of twenty eight and one half milliliter capacity. This container contains twenty nine grams of a facial cosmetic liquid of a selected one of a number of different basic colors in an oil in water emulsion. For example, there can be eight colors, well known in the art; gold, light gold, peach, light peach, rose, light rose, blush and light blush. These colors are obtained in known manner by mixing together different proportions of iron oxide colors identified in the art as russet, brown, yellow, red and ultramarine blue, as well as titanium dioxide, which when used provides a white color base.

Figure 3:
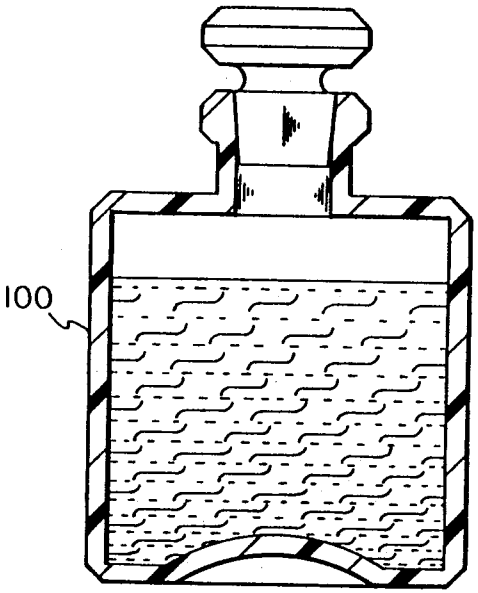
FIG. 3 is a partially cut away view of the container of FIG. 1 after the contents of the pouch of FIG. 2 has been mixed therein.
Figure 2:
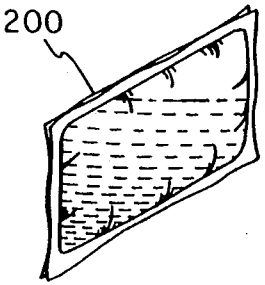
FIG. 2 is a partially cut away view of a small sealed pouch filled with a facial cosmetic liquid having another selected basic color.

Referring now to FIG. 2, there is shown a small sealed plastic pouch 200. Each pouch can contain a different one of the facial cosmetic liquids as the containers 100 but in much smaller volume. Alternatively, each pouch can contain different colors in different concentrations. These liquids can be oil in water emulsions or can be mere dispersions of color in water. Each pouch contains one gram of liquid. When the contents of any of the pouches are poured into a container, the container will be almost filled as shown in FIG. 3.

FIG. 4 shows a color chart which can be included in a kit. Disposed side by side in horizontal line are a series of large rectangles, 300 and 302. Each large rectangle identifies a different container with a different selected color. The actual number of large rectangles on the chart will depend upon the number of basic colors, typically eight. Disposed in a vertical column along the left side of the horizontal line of rectanges are a series of small rectangles, 400 and 402. Each rectangle identifies 0 different pouch with a different selected color. The actual number of small rectangles on the chart will depend upon the number of pouch colors, also typically eight. The large and small rectangles form a matrix. For each selected pair of large and small rectangles, the shade produced by adding the contents of the selected pouch to the contents of the selected color will be found at the intersection of a horizontal line drawn to the right of the selected pouch and a vertical line drawn downward from the selected container. An instruction sheet carries appropriate instructions.

What is claimed is:

1. A kit for preparing different colors and shades of facial cosmetic liquid make up comprising:

at least one facial cosmetic liquid container having a capacity of 28.5 milliliters and containing 29 grams of a first facial cosmetic liquid said liquid when applied to the skin of a user imparting a selected one of a plurality of different basic colors to the skin, said first liquid being an oil in water emulsion with water as the exteral phase and containing a selected color; and at least one sealed plastic pouch containing one gram of a second facial cosmetic liquid, the second liquid when combined and mixed with the first liquid in the container almost filling the container, the second liquid containing a mixture of water and a different color, the mixture when applied to the skin of a user imparting a selected one of a different plurality of different shades associated with said selected basic color to the skin.

2. A kit for preparing different colors and shades of facial cosmetic liquid make up comprising:

a first plurality of facial cosmetic liquid containers, each container having a capacity of 28.5 milliliters and containing 29 grams of a first facial cosmetic liquid , said liquid when applied to the skin of a user imparting a different selected one of a like first plurality of different basic colors to the skin, said first liquid being an oil in water emulsion with water as the external phase and containing a selected color;

a second plurality of sealed plastic pouches, each pouch having a like capacity and containing one gram of a second facial cosmetic liquid, said second liquid when combined and mixed with the first liquid in any one of the containers almost filling the container, the second liquid containing a mixture of water and a different color, the mixture when applied to the skin of a user imparting a different selected one of a like second plurality of different shades associated with said selected basic color to the skin; and a chart which enables a user to select different basic colors and shades by using different ones of the containers and different ones of the pouches.

* * * * *